US005535909A

United States Patent [19]

Philip

[11] Patent Number: 5,535,909

[45] Date of Patent: Jul. 16, 1996

[54] FLAT PACKING CONTAINER

[75] Inventor: Quentin M. C. Philip, Cirencester, England

[73] Assignee: Crocodile Packaging Ltd., England

[21] Appl. No.: 150,173

[22] PCT Filed: Jun. 1, 1992

[86] PCT No.: PCT/GB92/00985

§ 371 Date: Jan. 31, 1994

§ 102(e) Date: Jan. 31, 1994

[87] PCT Pub. No.: WO92/21574

PCT Pub. Date: Dec. 10, 1992

[30] Foreign Application Priority Data

May 30, 1991 [GB] United Kingdom ..... 9111595
Jul. 25, 1991 [GB] United Kingdom ..... 9116086

[51] Int. Cl.[6] ..... B65D 45/00

[52] U.S. Cl. ..... 220/4.33; 217/12; 217/13; 217/14; 217/12 R

[58] Field of Search ..... 217/12, 13, 14; 220/4.33

[56] References Cited

U.S. PATENT DOCUMENTS

| | | | |
|---|---|---|---|
| 2,168,911 | 8/1939 | Meyer | 24/81 |
| 2,579,897 | 12/1951 | Blechman | 20/92.7 |
| 2,760,674 | 8/1956 | Karp | 220/55 |
| 3,020,988 | 2/1962 | Bransford | 189/88 |
| 3,082,897 | 3/1963 | Highley | 217/65 |
| 3,323,674 | 6/1967 | Nist | 217/12 |
| 3,599,822 | 8/1971 | Johnson | 217/12 |
| 3,797,691 | 3/1974 | Williams, Jr. | 220/1.5 |
| 3,822,924 | 7/1974 | Lust | 312/111 |
| 3,949,874 | 4/1976 | Heavner | 206/386 |
| 3,949,929 | 4/1976 | Kupersmit | 229/23 |
| 3,990,599 | 11/1976 | Rowley | 217/12 |
| 4,024,977 | 5/1977 | Rowley | 217/12 |
| 4,083,464 | 4/1978 | Burnett | 217/13 |
| 4,239,149 | 12/1980 | Kupersmit | 229/45 |

FOREIGN PATENT DOCUMENTS

| | | |
|---|---|---|
| 550887 | 2/1986 | Australia . |
| 147549 | 11/1936 | Austria . |
| 1143674 | 3/1983 | Canada . |
| 8237095 | 1/1984 | Germany . |
| 2104582 | 3/1983 | United Kingdom . |
| WO90/08067 | 7/1990 | WIPO . |

*Primary Examiner*—Joseph M. Moy
*Attorney, Agent, or Firm*—Sheridan Ross & McIntosh

[57] ABSTRACT

A container comprising a multiplicity of panels, a multiplicity of retaining clips adapted to secure the panels when the container is erect and a multiplicity of storage clips, each storage clip comprising two legs, a first leg having a first foot arranged to be received beneath the panels when the latter is stacked and a second leg having a second foot adapted to be received in a recess in a top panel of the stack. The length of the first leg is arranged so that the top panel of the stack can be stacked with the internal face directed towards the adjacent panel with a restraining force being applied by the storage clip to the stack to restrain separation of the panels.

11 Claims, 5 Drawing Sheets

FLAT PACKING CONTAINER

FIELD OF THE INVENTION

This invention relates to a flat packing container and to clips for use in storage of demounted flat packing containers.

BACKGROUND OF THE INVENTION

Containers for automobile components, other engineering articles or bulk fluids are routinely composed of wooden panels held together by steel clips. Such arrangements are known from U.S. Pat. No. 3,323,674, U.S. Pat. No. 4,024,977, U.S. Pat. No. 4,083,464 and many other disclosures. In these arrangements the container may be dismantled by removal of the clips. Although the separate panels may be stacked together the clips are often lost or damaged. Usually an empty container is used for storage of the clips. This is inconvenient and is a waste of space and materials. In addition each set of panels may become separated from the requisite number of clips.

DETAILED DESCRIPTION OF THE INVENTION

Figure 1:
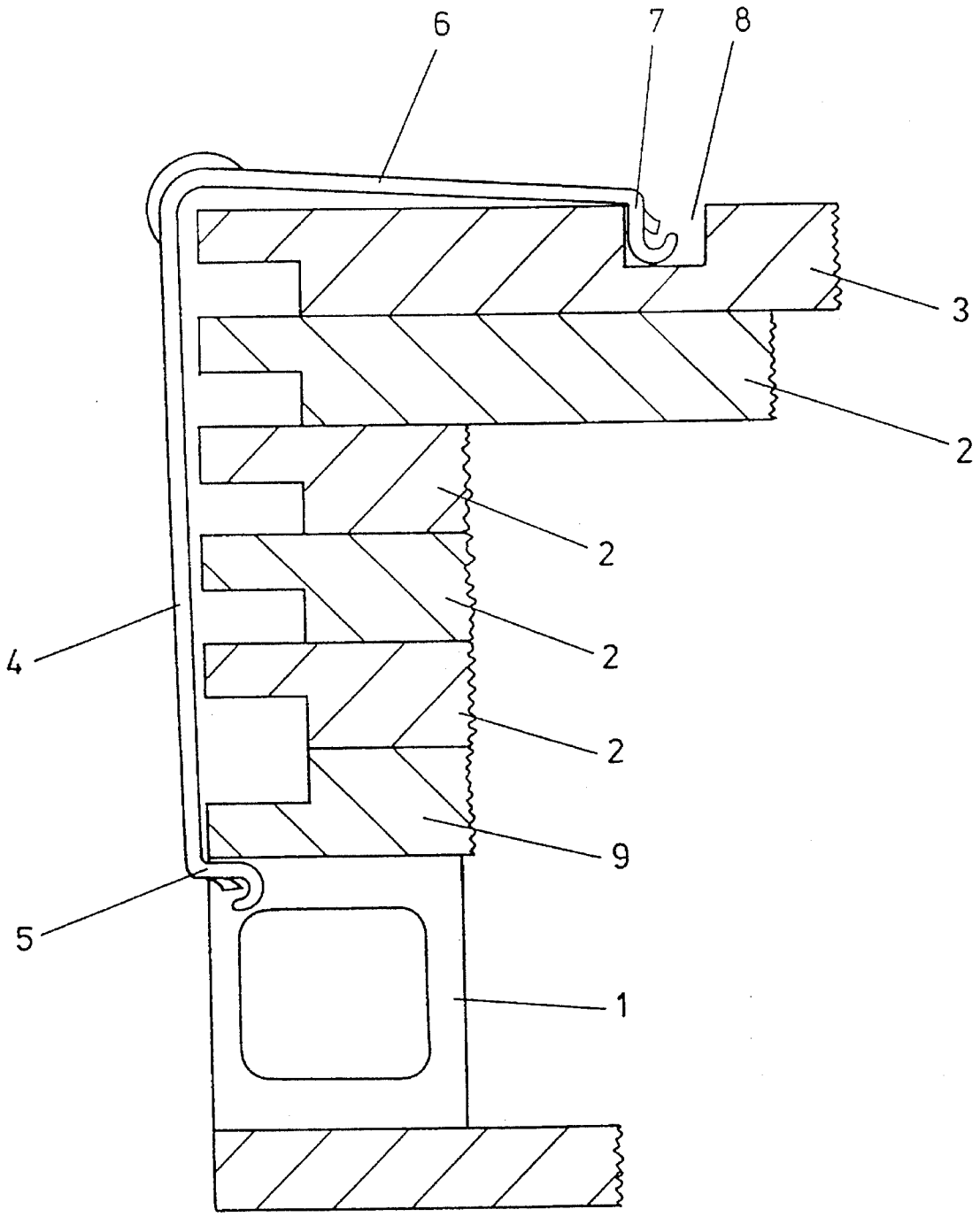
FIG. 1 is a cutaway cross-sectional view of the container of the present invention.

In accordance with a first aspect of the present invention a container comprises separate laminar panels, a multiplicity of retaining clips, the retaining clips being adapted to secure the panels when the container is erect, and a multiplicity of storage clips, each storage clip comprising two legs, a first leg having a first foot arranged to be received beneath the panels when the latter are stacked and the second leg having a second foot remote from the first leg adapted to be received in a recess in the top panel of the stack, the length of the first leg being arranged so that the top panel of the said stack can be stacked with the internal face directed toward the adjacent panel with a restraining force being applied by the storage clip to the stack to restrain separation of the panels.

A container in accordance with the present invention confers several advantages. The dimensions of the retaining clips may be standardised irrespective of variations in the thickness or number of panels to be retained by the storage clips. In addition the storage clips may perform further functions as described below.

Storage of the stacked panels with the upper panel facing inwardly prevents damage to dunnage or other fixtures which may be provided on the internal surface of the panels. This is important in preservation of the container for repeated use. Furthermore the internal surfaces of the container are kept clean so that the contents of the container are not contaminated before the container is erected for use. Storage of the stacked panels is facilitated and the stacks may in turn be stacked together.

In preferred embodiments of the invention the container includes a rectangular base block, the base block incorporating surfaces adapted to receive and retain a clip located at a corner of the block when the container is erect. Location of the clips at the corners of the base block serves to protect the latter from damage in use and prevents the clips from becoming separated from the respective container. The surfaces may comprise corners or edges of the base block or recesses in the block.

In further preferred embodiments of the invention one or both feet of the storage or retaining clips includes a formation defining an engagement for a tool. The formation may comprise a protrusion or aperture or, more preferably both. The formation is preferably arranged to be disposed entirely within the recess when the container is erect.

The formation at the end of a leg allows a tool such as a lever, screwdriver or the like to be inserted to facilitate removal of the clip from engagement with the panels of the container.

According to a second aspect of the present invention a container comprises separate laminar panels and a multiplicity of retaining clips, the retaining clips being adapted to secure the panels when the container is erect, each retaining clip comprising two legs, each leg having a foot arranged to be received in a recess of a respective panel and adapted to engage a wall of said recess to secure the panel, at least one foot of said clip incorporating a formation adapted to engage a tool to facilitate disengagement of the clip from said panel in use.

The formation is preferably arranged to be disposed entirely within the recess when the container is erect. Two or more formations may be provided on each foot as convenient.

In a preferred arrangement the legs of a clip lie close to the surfaces of the panel or panels without having any raised portions. The foot at the end of each leg is perpendicular to the leg so that a minimal portion of the foot is disposed outside the recess in use. Each formation protrudes into the recess from the foot and does not extend from the recess to provide an obstacle in use. Preferred formations extend towards the bottom of the recess at an acute angle to the foot. This has the advantage that force applied to the formation, for example by leverage by a tool bearing on the opposite corner of the recess, deforms the foot away from the surface of the panel and releases the restraining force applied by the clip.

Location of the formations within the recess is important, particularly when the containers carry heavy loads. Stacking of filled containers may result in forces of one tonne being applied to the clips and any raised formations of the latter may be liable to fracture. Furthermore formations raised above the surface of the panel may provide an aperture in which stones or swarf may be lodged enhancing the likelihood of fracture of the clip as a load is applied. Removal or stacking of the containers using a forklift may cause clips of adjacent containers to contact one another causing damage to the latter and creating a possibility that a clip may be disengaged causing collapse of the container.

Storage clips may be constructed in a similar manner to the retaining clips described above.

The formation may comprise an aperture in said foot or a protrusion extending from the foot. A preferred formation comprises a lug or tongue extending from the foot to form an aperture. Such a lug or tongue may be formed by stamping or pressing from the foot. A screwdriver or other tool inserted into the recess to engage the lug may be further received into the aperture. This serves to prevent the tool from being dislodged laterally from the lug during removal. Perforation of the foot has the advantage of improving the flexibility of that part of the clip facilitating application and removal in use.

The legs of a clip in accordance with the present invention may join to form an elbow, preferably at an angle less than 90° so that the feet are urged into the recesses in use by resilience of the clip. The elbow preferably includes one or more raised formations extending from the outer surface thereof. These raised formations improve the rigidity of the clip and allow use of thinner metal. In addition the raised formations facilitate movement of the container across a floor by providing a reduced area of contact with the floor. Friction is reduced and scratching or scoring of the body of the clip is also reduced.

Figure 2:
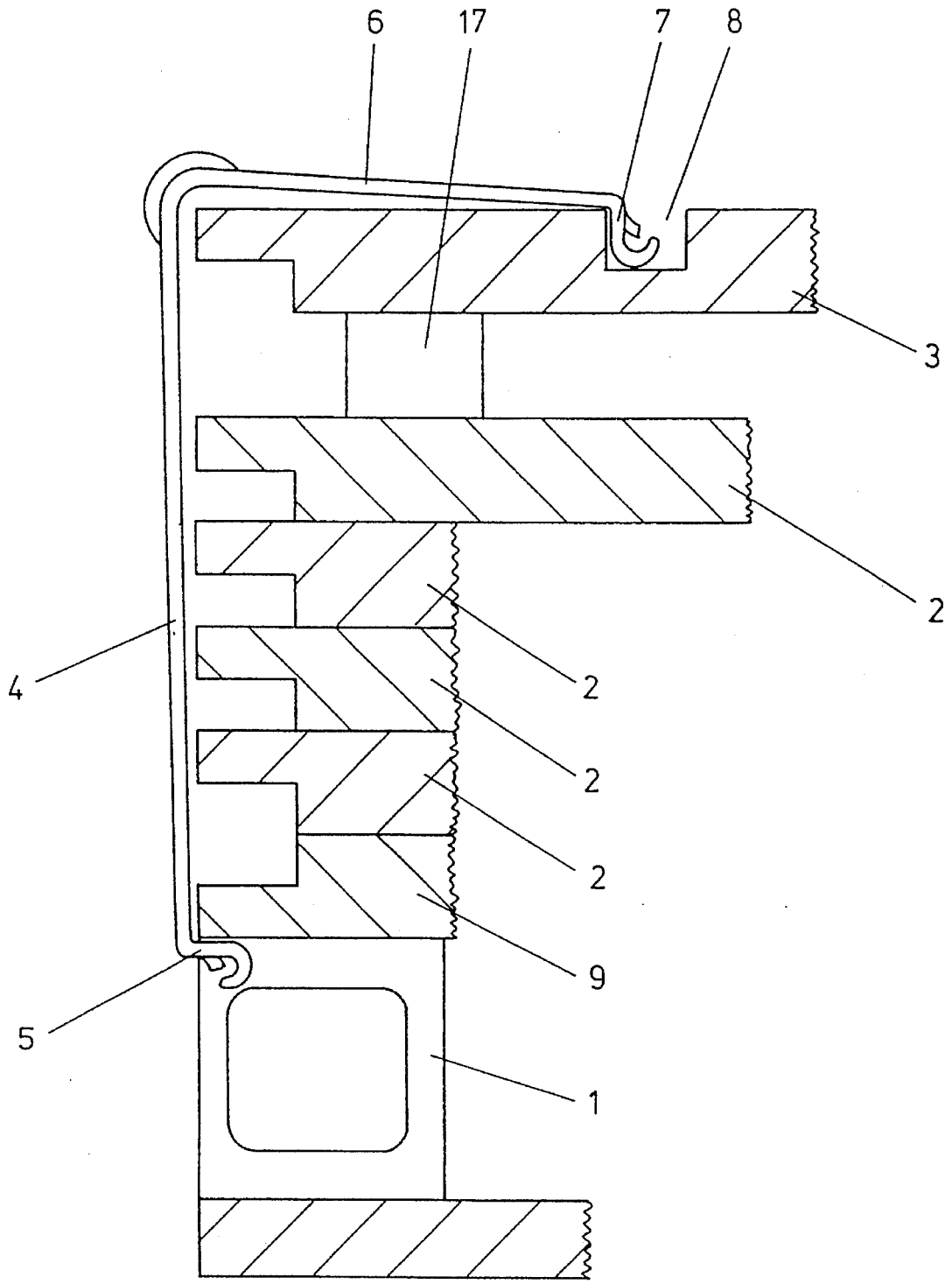
FIG. 2 is a cutaway cross-section of the container of the present invention illustrating storage of the panels of a container where the lid incorporates dunnage.
Figure 3:
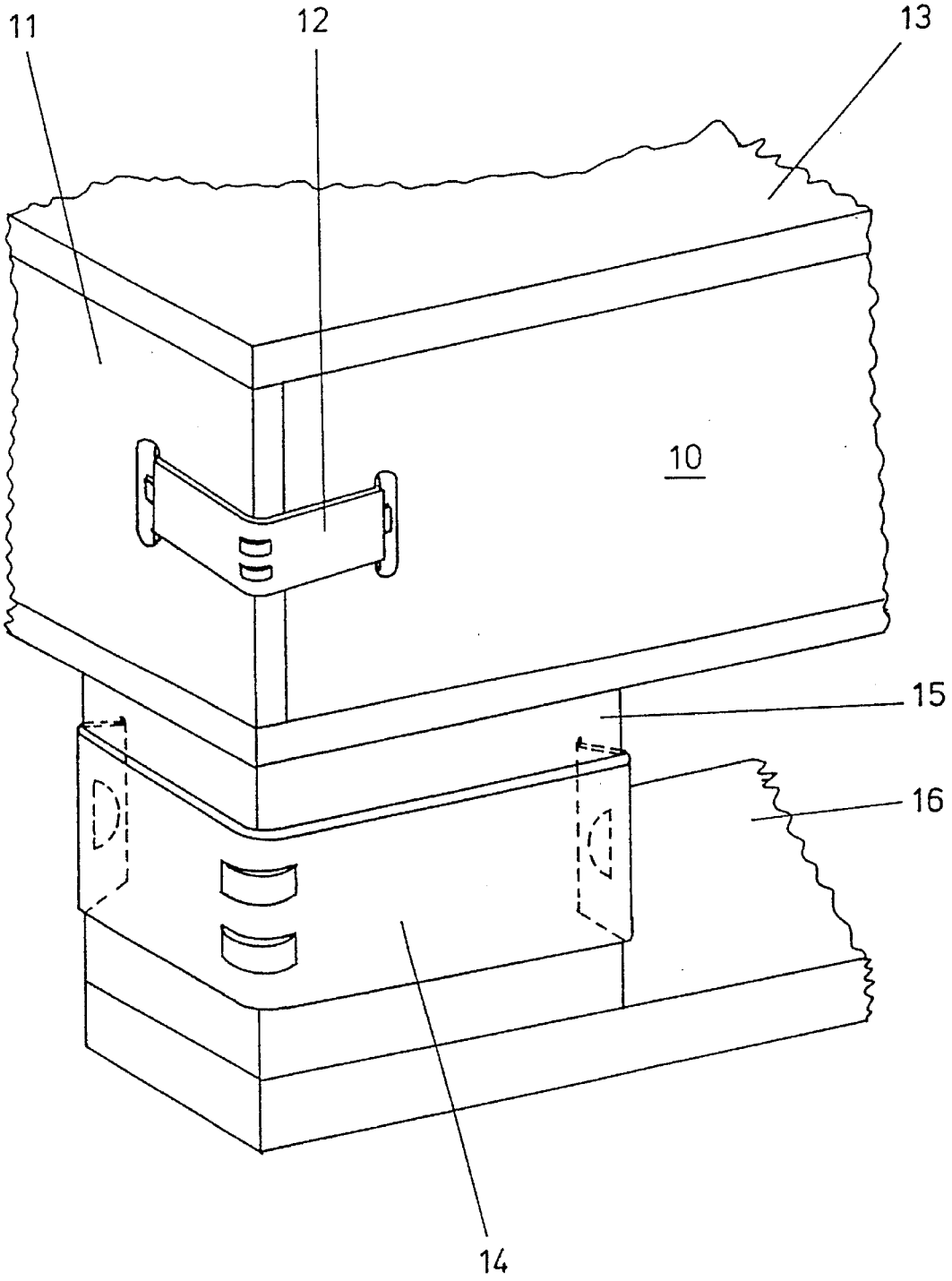
FIG. 3 is a schematic drawing of an erect container illustrating a side panel, end panel and lid assembled for use.

The invention is further described by means of example but not in any limitative sense with reference to the accompanying drawings of which:

FIG. 1 is a partial view of an elevation illustrating a container in accordance with the invention;

FIG. 2 is a partial view of an elevation illustrating use of a clip with a container incorporating dunnage;

FIG. 3 is a partial view of an erect container; and

FIG. 4 illustrates a preferred retaining clip.

The arrangement shown in FIG. 1 illustrates a demounted container comprising a base block 1 secured to a base panel 9 which forms the lower wall of the container, and four side panels 2. A lid 3 is disposed upon the upper side panel 2 and faces downwardly so that the internal surface is protected from damage. The clip comprises a first leg 4 having a foot 5 adapted to be received under the base panel 9, in engagement with the lower surface thereof. An arm 6 extends from the leg 4 in generally perpendicular relation along the surface of the lid 3. A foot 7 remote from the leg 4 is received in a rebate 8 in the lid to retain the clip in position. The angle between the leg 4 and arm 6 may be less than 90°, for example 80° when the clip is not in use, so that the clip exerts a resilient restraining force on the panels holding them together during storage of the panels. The clip can be removed by insertion of a screwdriver or similar tool into the rebate 8. The length of the leg 4 is selected so that the clip fits tightly over the base panel, four side panels and lid of the container.

A foot 7 received within the rebate 8 is entirely disposed within the latter, preventing accidental dislodgement or damage to the clip in use. The foot 7 incorporates a curved end to facilitate insertion into the recess 8 and also incorporates a formation to facilitate engagement with a tool during removal from the stacked panels. The foot including the curved end portion and engagement do not, in preferred embodiments of the invention, extend to the surface of the recess opposite that engaged by the foot. Contact between the foot and the opposite surface of the recess is not preferred since this can cause delamination of the panel upon removal of the clip from the recess. Division of sufficient space to allow the tool to be inserted is also helpful for ease of use.

Retaining clips may have a similar construction to the storage clips shown in FIG. 1. In particular the construction of the feet and their relationship to the dimensions of the recesses of the panels is preferably similar, particularly so that the clips are not prone to accidental disengagement or damage.

FIG. 2 illustrates storage of the panels of a container wherein the lid incorporates dunnage. The term dunnage is used to refer to battens or other formations secured to the internal surfaces of the container to engage and support an article disposed within the container. It is important that dunnage is not damaged when the container is not in use. In FIG. 2 the same reference numerals as are used in FIG. 1 are employed to denote like parts. In FIG. 2 four panels 2 are stacked on a base panel 9 mounted on a base block 1. The cover 3 carrying dunnage 17 is stacked on the upper panel 2 with the dunnage facing inwardly. The leg 4 of the storage clip is longer than that of the clip shown in FIG. 1 to compensate for the increased thickness of the stack due to the dunnage 17. In further alternative embodiments of the invention the panels 2 or base 9 may also carry dunnage, the dimensions of the clip being selected accordingly.

FIG. 3 is not to scale and illustrates an erect container illustrating a side panel 10, end panel 11 and lid 13 assembled for use. The side and end panels 10, 11 are secured together by a retaining clip 12 received in rebates (not shown) in the panels. The lid 13 may be secured by retaining clips in similar manner. The relating dimensions of the panels and clips may be varied as convenient.

The storage clip 14 is shown engaged on the base block 15 of the base of the container. The dimensions of the base block may be selected to engage the clip without need for formation of rebates. The runner 16 defines the floor engagement surface of the container. The clip 14 serves to protect the base block 15 in use, for example by accidental engagement with the tines of a forklift or other cargo handling equipment. When the container is demounted for storage the clip 14 may be removed rom the base 15 and engaged with the stacked panels as shown in FIGS. 1 and 2.

Figure 4A:
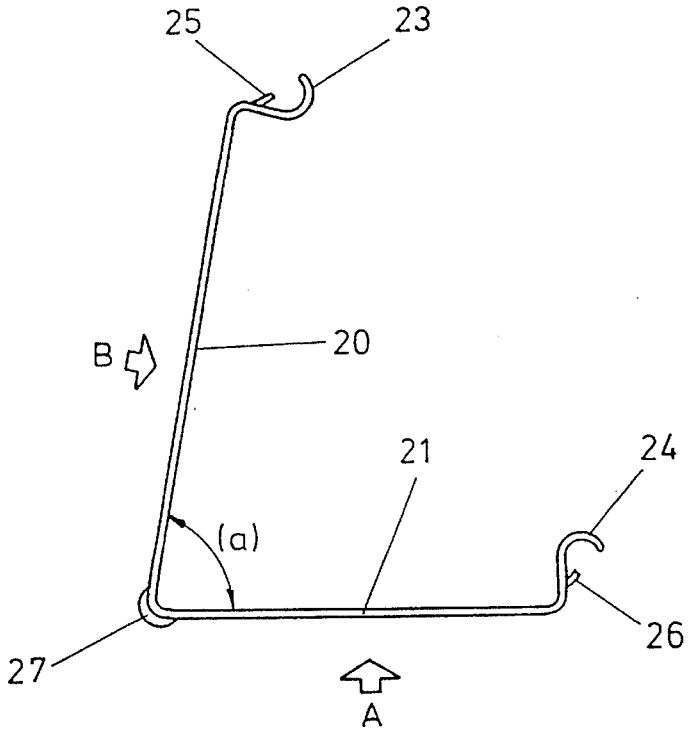
FIG. 4*a* is an elevational view of a preferred configuration of a clip in accordance with the present invention.
Figure 4B:
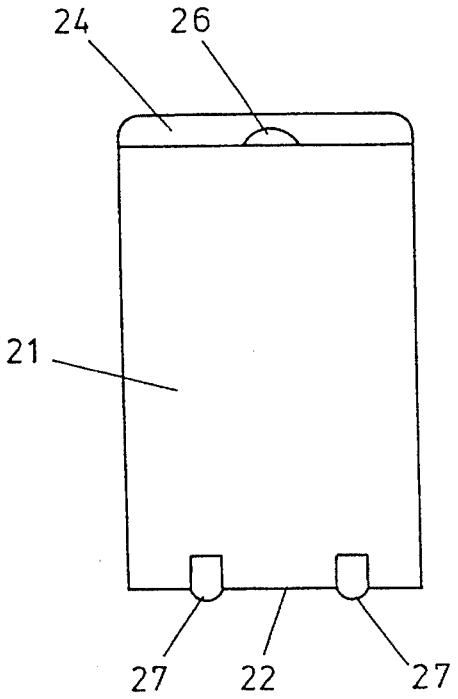
FIG. 4*b* is a side view of the preferred configuration of a clip and container in accordance with the present invention.
Figure 4C:
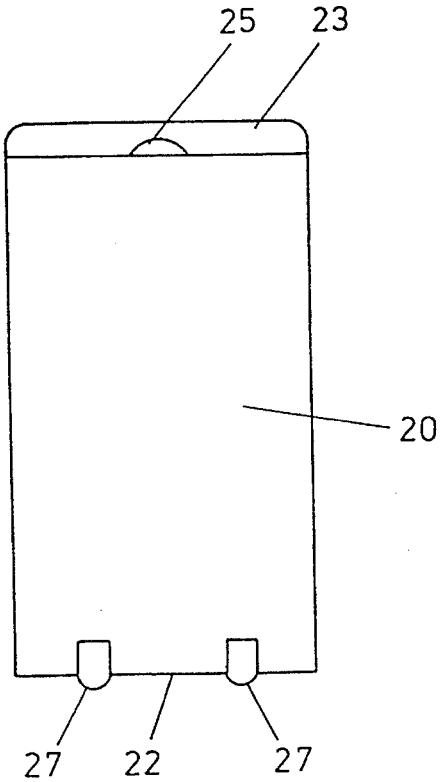
FIG. 4*c* is a further side view of the preferred clip configuration in accordance with the present invention.

FIG. 4 illustrates a preferred configuration of clip in accordance with this invention. Both the retaining and storage clips may have the configuration shown in the figures although the dimensions may vary. FIG. 4*a* is an elevation and FIG. 4*b* is a view on A of FIG. 4*a*. FIG. 4*c* is a view from B of FIG. 4*a*. The clip shown in FIGS. 4*a*, 4*b* and 4*c* comprises legs 20, 21 joined at an elbow 22. When not in use, the angle, a between the legs is less than 90°, for example approximately 80° so that the clip bears against and resiliently engages the panels of the container. The legs 20, 21 incorporate inwardly inclined feet 23, 24. The feet may have curved end portions to facilitate deformation of the clip during engagement with the surfaces of the recesses of the panels of the container. Perforations 25, 26 define apertures into which a screwdriver or other tool may be inserted to release the clip from panels of a container. In alternative embodiments two or more perforations 25, 26 may be provided on each foot as convenient to facilitate engagement with a tool as shown in FIG. 5.

Raised formations 27 provided on the elbow 22 serve to increase the strength and resilience of the elbow and also to act as bearing surfaces for the clip against the ground. Friction with the ground is reduced and damage to the clip, which may result in corrosion is also reduced.

Figure 5:
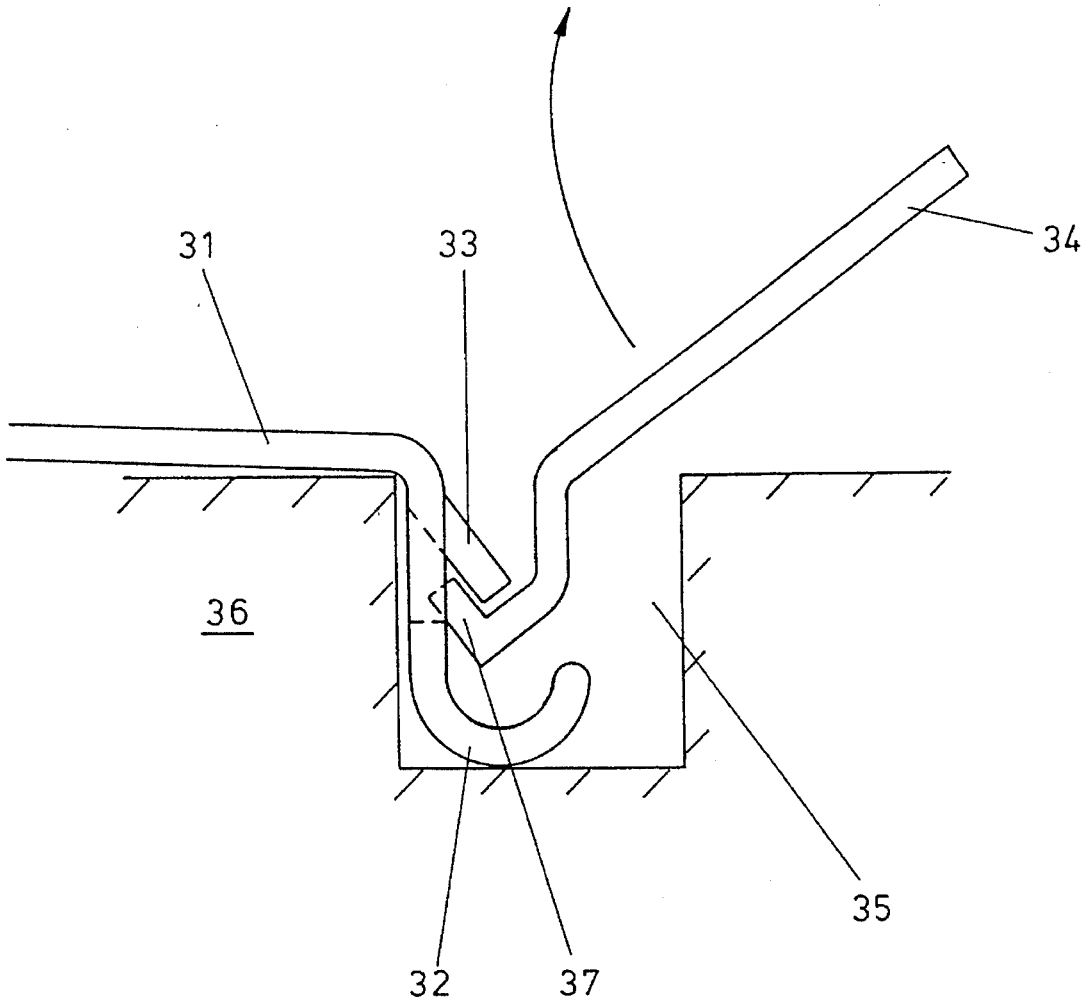
FIG. 5 is a schematic cross-sectional drawing illustrating a foot of a storage or retaining clip in accordance with the present invention.

FIG. 5 illustrates a foot of a storage or retaining clip in accordance with this invention. Clip leg 31 incorporates a foot 32 having a curved end portion to facilitate engagement over the surface of the panels 36 into the recess 35. A projection 33 pressed from the foot 32 creates an aperture 38. A tool 34 may be inserted in use into the recess 35 under the formation 33 and into engagement within the recess 38.

Reception in the recess 38 is preferred to prevent the tool from being dislodged laterally from the formation 33. The tool may then be used to lever the clip from engagement with the panel. The tool 34 may have any convenient construction. The formation 33 and recess 38 may be arranged to receive a screwdriver or other commonplace implement. Alternatively the tool may be adapted for use with the present invention.

The projection or formation 33 extends downwardly from the foot towards the bottom of the recess. Obstruction of adjacent containers or other articles by the foot and projection is minimised. In addition leverage of the projection 33 by the tool 34 which may be achieved by downward pressure on the tool against the opposite corner of the recess 35, urges the foot away from the wall of the recess, releasing the pressure applied by the clip. Insertion of a screwdriver or other tool between the leg 31 and panel 36 would be less desirable and may cause the foot to delaminate the plywood from which the panels are usually formed.

In preferred embodiments of the invention the container comprises a base, a plurality of panels, clips and a tool which may be provided as a kit of parts. In alternatively embodiments of the invention the formation 33 may be arranged so that a clip may serve as a tool for removal of further clips. A foot of such a clip may be curved or hooked to allow engagement beneath the formation 33 in use.

While various embodiments of the present invention have been described in detail, it is apparent that modifications and adaptations of those embodiments will occur to those skilled in the art. It is to be expressly understood, however, that such modifications and adaptations are within the scope of the present invention, as set forth in the following claims:

What is claimed is:

1. A container comprising separate laminar panels having recesses therein, a multiplicity of retaining clips, said retaining clips being adapted to secure said panels when said container is erect, each retaining clip comprising two legs, each of said legs having a foot having a curved end arranged to be received in a recess of a respective panel and adapted to secure said panel, wherein at least one foot of said clip incorporates a protrusion provided prior to said curved end of said foot and extending from said foot, said protrusion adapted to engage a tool to facilitate disengagement of said clip from said panel.

2. A container as claimed in claim 1 further comprising a base block, said base block incorporating surfaces adapted to receive and retain said clips when said container is erect.

3. A container as claimed in claim 2, wherein said surfaces comprise recesses located adjacent corners of said base blocks.

4. A container as claimed in claim 1 wherein said clips include a formation defining an engagement for a tool, said formation selected from the group consisting of a lug and a tongue extending from said foot.

5. A container as claimed in claim 4, wherein said engagement comprises a protrusion from said first or second foot.

6. A container as claimed in claim 4 wherein said engagement comprises an aperture in said first or second foot.

7. A container comprising separate laminar panels having recesses therein, and a multiplicity of retaining clips, the retaining clips being adapted to secure said panels when the container is erect, each retaining clip comprising two legs, each of said legs having a foot having a curved end arranged to be received in the recess of a respective panel and adapted to engage a wall of said recess to secure the panel, at least one foot of said clip incorporating a formation provided prior to said curved end of said foot and extending from said foot, said formation adapted to engage a tool to facilitate disengagement of the clip from said panel.

8. A container as claimed in claim 7 wherein said formation is arranged to be disposed entirely within said recess when said container is erect.

9. A container as claimed in claim 1 further comprising a tool to facilitate removal of said clips.

10. A container as claimed in claim 9 wherein said tool comprises a further clip.

11. A container comprising separate laminar panels, a multiplicity of retaining clips being adapted to secure said panels when the container is erect, and a multiplicity of storage clips, said storage clips comprising first and second legs, said first leg having a first foot arranged to be received beneath said panels when said panels are stacked, and said second leg having a second foot remote from said first leg, adapted to be received in a recess in said top panel of said stack, said first foot and said second foot having a curved end, the length of said first leg being arranged so that said top panel of said stack can be stacked with the internal face of said panel directed towards an adjacent panel, with a retaining force being applied by said retaining clips to restrain separation of said panels, said container including a base block, having recesses located adjacent corners of said base block, said recesses adapted to receive and retain said storage clips when said container is erect, said storage clips and said retaining clips having a protrusion defining an engagement for a tool, said protrusion provided prior to said curved end of said foot add extending from said foot.

* * * * *